US010454232B2

(12) United States Patent
Kerstetter et al.

(10) Patent No.: US 10,454,232 B2
(45) Date of Patent: Oct. 22, 2019

(54) TERMINAL LOCATOR FOR A TERMINAL CRIMPING DEVICE

(71) Applicant: TE CONNECTIVITY CORPORATION, Berwyn, PA (US)

(72) Inventors: Chadwick Alan Kerstetter, Richfield, PA (US); Todd Matthew Troutman, Hershey, PA (US)

(73) Assignee: TE Connectivity Corporation, Berwyn, PA (US)

( * ) Notice: Subject to any disclaimer, the term of this patent is extended or adjusted under 35 U.S.C. 154(b) by 237 days.

(21) Appl. No.: 15/499,410

(22) Filed: Apr. 27, 2017

(65) Prior Publication Data

US 2017/0324207 A1 Nov. 9, 2017

Related U.S. Application Data

(60) Provisional application No. 62/331,793, filed on May 4, 2016.

(51) Int. Cl.
*H01R 43/042* (2006.01)
*H01R 43/048* (2006.01)
(Continued)

(52) U.S. Cl.
CPC ..... *H01R 43/048* (2013.01); *H01R 43/04* (2013.01); *H01R 43/058* (2013.01); *Y10T 29/53209* (2015.01); *Y10T 29/53235* (2015.01)

(58) Field of Classification Search
CPC ..... H01R 43/042; H01R 4/26; H01R 43/04; H01R 43/048; Y10T 29/53235;
(Continued)

(56) References Cited

U.S. PATENT DOCUMENTS 3,402,452 A 9/1968 Mraz
6,324,884 B1 * 12/2001 Barjesteh ..... B21D 39/046 29/237
(Continued)

FOREIGN PATENT DOCUMENTS

DE 202008003703 U1 5/2008
EP 2728681 A1 5/2014
(Continued)

OTHER PUBLICATIONS

European Search Report, European Application 17169256.9, International Filing Date Aug. 24, 2017.

*Primary Examiner* — Thiem D Phan

(57) ABSTRACT

A terminal locator for holding a terminal in a crimping zone of a terminal crimping device includes a housing configured to be positioned forward of crimp tooling defining the crimping zone. The housing has a terminal cavity extending along a terminal axis configured to receive the terminal such that a crimp barrel of the terminal extends rearward of the housing along the terminal axis into the crimping zone for crimping to a wire. A spacer is held by the housing. The spacer has a spacer blocking surface configured to locate the terminal and block axial rearward movement of the terminal. A latch is held by the housing. The latch is deflectable to allow insertion and removal of the terminal from the terminal cavity, the latch having a latch blocking surface configured to locate the terminal and block axial forward movement of the terminal.

20 Claims, 7 Drawing Sheets

(51) Int. Cl.
*H01R 43/04* (2006.01)
*H01R 43/058* (2006.01)

(58) Field of Classification Search
CPC ..... Y10T 29/5193; Y10T 29/53226; Y10T 29/53209; Y10T 29/49135; Y10T 29/53513; Y10T 29/53996; Y10T 29/49185; Y10T 29/53065
USPC ..... 29/753, 747, 751, 760, 857, 861, 874
See application file for complete search history.

(56) References Cited

U.S. PATENT DOCUMENTS 6,532,790 B2 * 3/2003 Frenken ..... B23D 23/00
72/409.16
9,209,585 B2 * 12/2015 Houser ..... H01R 43/0427

FOREIGN PATENT DOCUMENTS

JP S59777790 U 5/1984
JP H0597084 U 12/1993

* cited by examiner

TERMINAL LOCATOR FOR A TERMINAL CRIMPING DEVICE

CROSS REFERENCE TO RELATED APPLICATIONS

This application claims the benefit of U.S. Provisional Application No. 62/331,793 filed May 4, 2016 titled TERMINAL LOCATOR FOR A TERMINAL CRIMPING DEVICE, the subject matter of which is herein incorporated by reference in its entirety.

BACKGROUND OF THE INVENTION

The subject matter herein relates generally to terminal crimping devices for crimping terminals to wires.

Terminal crimping machines have long been used in the connector industry to terminate terminals to ends of wires. Various terminal crimping machines are hand-tools; however to automate the termination process and thereby speed up the termination process and provide a more repeatable and reliable termination, some terminal crimping machines are electrically, hydraulically or pneumatically actuated. Such terminal crimping machines are typically referred to as a terminator or press. The terminal crimping machines include a movable ram that is moved towards an anvil during a crimping stroke to crimp a terminal to an end of a wire received in a crimping zone between the ram and the anvil.

Some terminal crimping machines, such as machines used for termination of large wires to large wire terminals, have an operator hold the terminal to position the terminal in place in the machine until the crimp tooling has closed enough to grip the terminal. Along with the inefficiency in a manual process, there is a risk of injury to the operator, such as to the operators hand or fingers, when holding the terminal near the crimping zone.

A need remains for a terminal crimping machine that allows hands-free operation and positioning of the terminal during the crimping operation.

BRIEF DESCRIPTION OF THE INVENTION

In one embodiment, a terminal locator is provided for holding a terminal in a crimping zone of a terminal crimping device that includes a housing configured to be positioned forward of crimp tooling defining the crimping zone. The housing has a terminal cavity extending along a terminal axis configured to receive the terminal such that a crimp barrel of the terminal extends rearward of the housing along the terminal axis into the crimping zone for crimping to a wire. A spacer is held by the housing. The spacer has a spacer blocking surface configured to locate the terminal and block axial rearward movement of the terminal. A latch is held by the housing. The latch is deflectable to allow insertion and removal of the terminal from the terminal cavity, the latch having a latch blocking surface configured to locate the terminal and block axial forward movement of the terminal.

In another embodiment, a terminal crimping device is provided that crimps a terminal to a wire that includes crimp tooling including a movable ram and an anvil defining a crimping zone. The movable ram is movable along a crimp stroke towards and away from the anvil, The crimp tooling crimps the terminal to the wire during the crimp stroke. The terminal crimping device includes a terminal locator configured to hold the terminal in the crimping zone during the crimp stroke. The terminal locator includes a housing configured to be positioned forward of crimp tooling defining the crimping zone. The housing has a terminal cavity extending along a terminal axis configured to receive the terminal such that a crimp barrel of the terminal extends rearward of the housing along the terminal axis into the crimping zone for crimping to a wire. A spacer is held by the housing. The spacer has a spacer blocking surface configured to locate the terminal and block axial rearward movement of the terminal. A latch is held by the housing. The latch is deflectable to allow insertion and removal of the terminal from the terminal cavity, the latch having a latch blocking surface configured to locate the terminal and block axial forward movement of the terminal.

In a further embodiment, a crimping system is provided including a driving mechanism, crimp tooling and a terminal locator. The driving mechanism is driven in an axial driving direction during a crimping operation. The crimp tooling includes a movable ram and an anvil defining a crimping zone. The movable ram is coupled to the driving mechanism and is movable along a crimp stroke towards and away from the anvil by the driving mechanism during the crimping operation. The crimp tooling crimps the terminal to the wire during the crimp stroke. The terminal locator is configured to hold the terminal in the crimping zone during the crimp stroke. The terminal locator includes a housing configured to be positioned forward of crimp tooling defining the crimping zone. The housing has a terminal cavity extending along a terminal axis configured to receive the terminal such that a crimp barrel of the terminal extends rearward of the housing along the terminal axis into the crimping zone for crimping to a wire. A spacer is held by the housing. The spacer has a spacer blocking surface configured to locate the terminal and block axial rearward movement of the terminal. A latch is held by the housing. The latch is deflectable to allow insertion and removal of the terminal from the terminal cavity, the latch having a latch blocking surface configured to locate the terminal and block axial forward movement of the terminal.

DETAILED DESCRIPTION OF THE INVENTION

Figure 1:
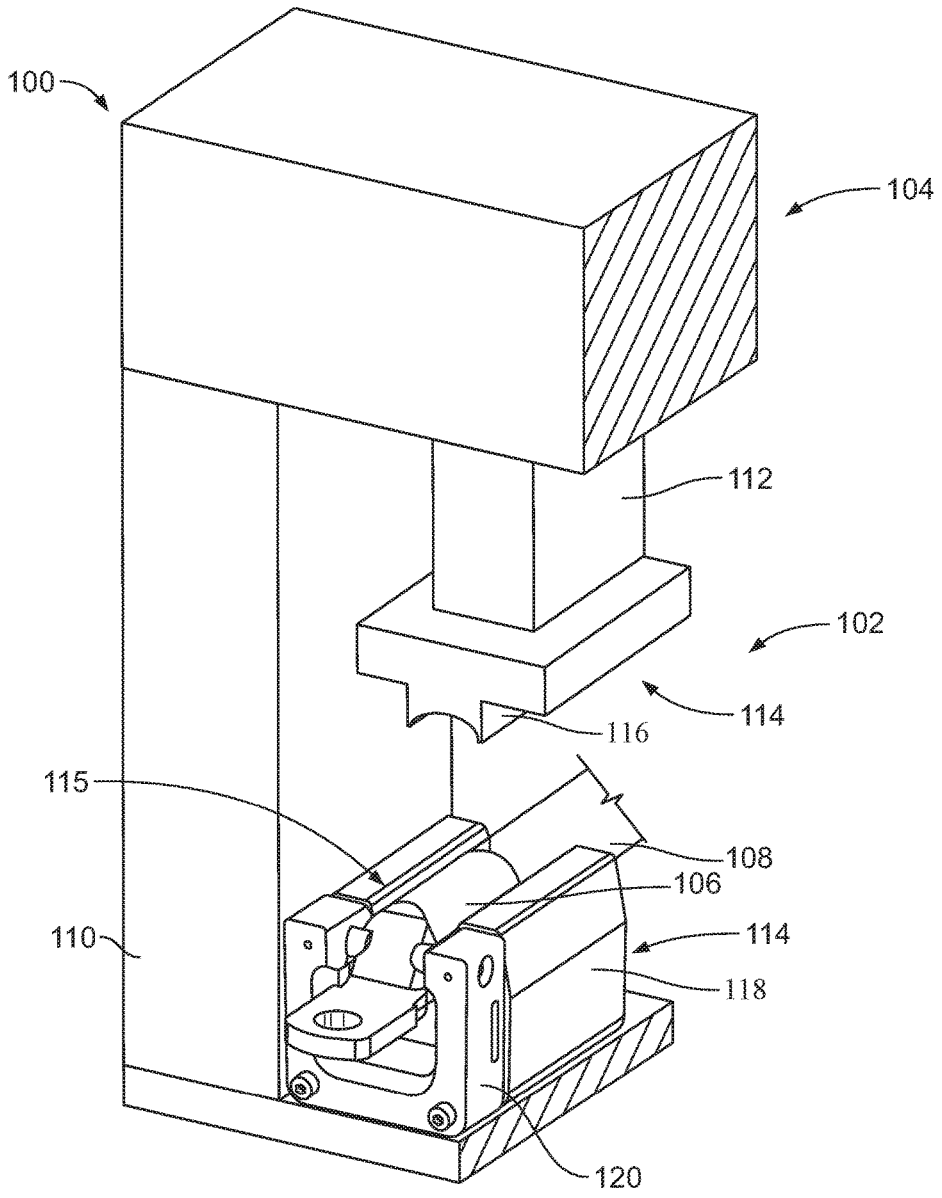
FIG. 1 is a front perspective view of a crimping system in accordance with an exemplary embodiment.

FIG. 1 is a front perspective view of a crimping system 100 in accordance with an exemplary embodiment. The crimping system 100 includes a terminal crimping device 102 and a crimping machine 104 that holds the terminal crimping device 102 and operates the terminal crimping device 102. The terminal crimping device 102 is used for crimping a terminal 106 onto a wire 108, such as to produce an electrical lead. Optionally, the terminal 106 may be a power terminal and the wire may be a power cable; however the terminal 106 may be a signal contact in other embodiments. The crimping machine 104 may be a terminator that presses the terminal crimping device 102 during a crimping operation. The crimping machine 104 provides the motive force for the crimping process or operation. The terminal crimping device 102 mechanically forms the terminal 106 around the wire 108 during each crimping operation.

The crimping machine 104 includes a frame 110 that supports a driving mechanism 112 used to move the terminal crimping device 102 during the crimping operation. The frame 110 may support other components, such as a terminal feeder device that supplies the terminals 106, a wire feeder device that supplies the wires 108, or other components.

The terminal crimping device 102 includes crimp tooling 114 defining a crimping zone 115. The terminal 106 and wire 108 are received in the crimping zone 115 and crimped by the crimp tooling 114 in the crimping zone 115. The crimp tooling 114 includes a movable ram 116 and an anvil 118. In an exemplary embodiment, the anvil 118 is stationary; however, the anvil 118 may be movable in alternative embodiments. The terminal crimping device 102 includes a terminal locator 120 for holding the terminal in the crimping zone 115 during the crimping operation. The terminal locator 120 supports the terminal 106 such that the operator does not need to hold the terminal 106 by hand. The terminal locator 120 provides a hands-free crimping operation. Optionally, the terminal crimping device 102, or various components thereof, may be removed and replaced within the crimping machine 104, such as when a different size/type of terminal 106 is to be terminated, when a different size/type of wire 108 is to be terminated, when the components are worn or damaged, or when a machine having a different configuration is desired.

When assembled, the ram 116 is coupled to the driving mechanism 112. The driving mechanism 112 is driven in an axial driving direction (e.g., vertically up-and-down) during a crimping operation. The movable ram 116 is actuated by the driving mechanism 112 and movable along a crimp stroke towards and away from the anvil 118 by the driving mechanism 112 during the crimping operation. The driving mechanism 112 may be a motor having a crank shaft that moves the ram 116. Alternatively, the driving mechanism 112 may be a linear actuator, a piezoelectric actuator, a pneumatic actuator, or the like. The ram 116 is moved along the driving axis in an advancing direction and a retracting direction relative to the anvil 118 during the crimp stroke. The anvil 118 receives the terminal 106 and the wire 108 in the crimping zone 115 and supports the terminal 106 against the pressing operation of the ram 116 during the crimp stroke. For example, the ram 116 and the anvil 118 both engage the terminal 106 and form or crimp the terminal 106 around the wire 108 such that the terminal 106 locks onto the wire 108. The terminal 106 and/or the wire 108 may at least partially extrude during the crimping operation to form a mechanical and electrical connection therebetween. In an exemplary embodiment, the terminal 106 is sealed to the wire 108 once crimped thereto. Optionally, the terminal 106 may be a closed-end terminal to provide a sealed barrel around the wire 108.

Figure 2:
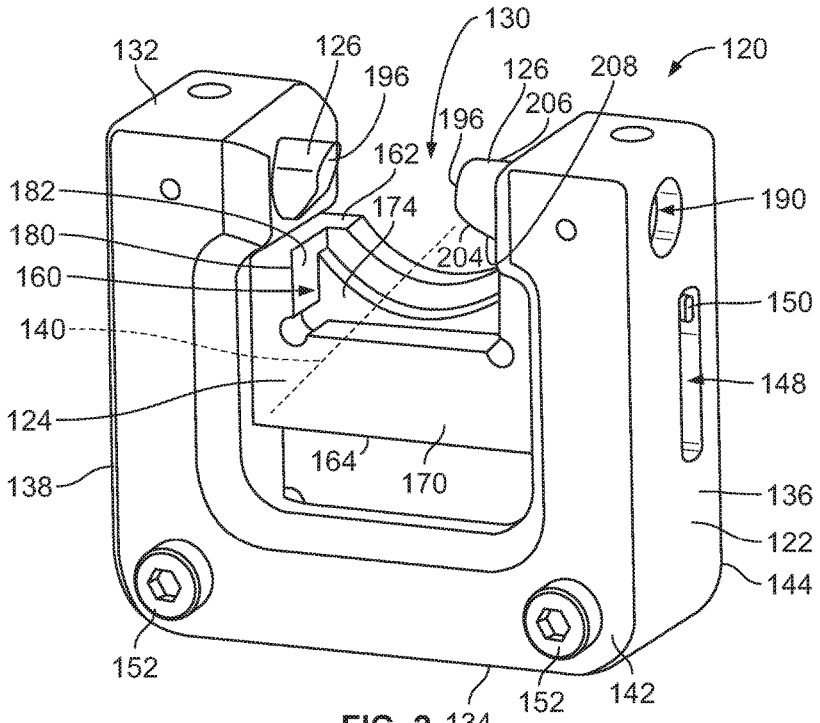
FIG. 2 is a front perspective view of a terminal locator of the crimping system in accordance with an exemplary embodiment.
Figure 3:
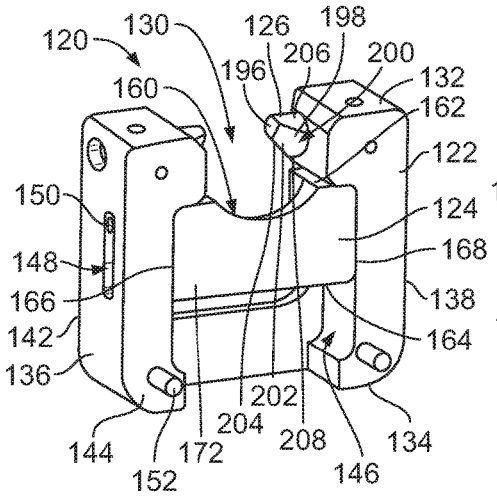
FIG. 3 is a rear perspective view of the terminal locator in accordance with an exemplary embodiment.
Figure 4:
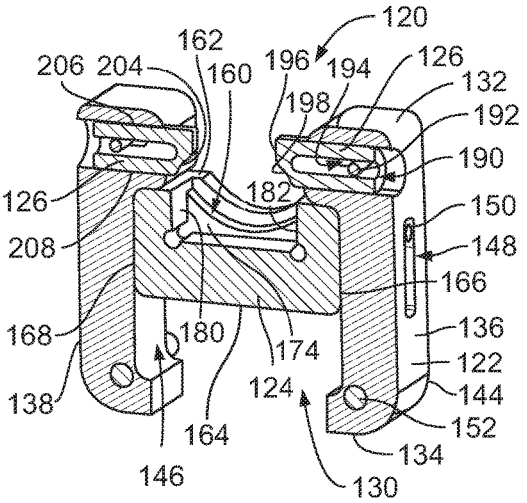
FIG. 4 is a sectional view of the terminal locator in accordance with an exemplary embodiment.

FIG. 2 is a front perspective view of the terminal locator 120 in accordance with an exemplary embodiment. FIG. 3 is a rear perspective view of the terminal locator 120 in accordance with an exemplary embodiment. FIG. 4 is a sectional view of the terminal locator 120 in accordance with an exemplary embodiment. The terminal locator 120 includes a housing 122, which may be coupled to the anvil 118 (shown in FIG. 1), a spacer 124 held by the housing 122, and latches 126 held by the housing 122. The terminal locator 120 is used for holding the terminal 106 (shown in FIG. 1) in the crimping zone 115 (shown in FIG. 1). In an exemplary embodiment, the terminal locator 120 is used to block axial movement of the terminal 106 and/or block rotational movement of the terminal 106.

The housing 122 defines a terminal cavity 130 configured to receive the terminal 106. In the illustrated embodiment, the housing 122 is U-shaped around the terminal cavity 130 having an open top 132 through which the terminal 106 is received and removed. The housing 122 includes a bottom 134 opposite the top 132 and sides 136, 138 extending between the top 132 and the bottom 134. The housing 122 may have other shapes in alternative embodiments. The terminal cavity 130 extends along a terminal axis 140 between a front 142 and a rear 144 of the housing 122. The terminal cavity 130 receives the terminal 106 generally along the terminal axis 140.

In an exemplary embodiment, the housing 122 includes a spacer channel 146 that receives the spacer 124. The spacer channel 146 may be open at the rear 144 to receive the spacer 124. Optionally, the spacer 124 may be moveable relative to the housing 122 within the spacer channel 146. For example, the spacer 124 may be moveable perpendicular to the terminal axis 140 in the spacer channel 146. The spacer 124 may be spring biased to a resting or normal position, which may be at the top of the spacer channel 146. Optionally, the spacer 124 may be moveable vertically (e.g., up and down) within the spacer channel 146. The walls of the housing 122 may guide movement of the spacer 124 within the terminal cavity 130. Having the spacer 124 moveable relative to the housing 122 allows the terminal 106 to be positioned within the terminal cavity 130 and accommodates movement of the terminal 106 during the crimping operation. For example, during the crimping operation, the terminal 106 may be moved downward. The terminal 106 may move during the crimping operation as the terminal 106 is being extruded.

In the illustrated embodiment, the housing 122 includes guide channels 148 at the sides 136, 138. The guide channels 148 receive guide pins 150 coupled to the spacer 124. The guide channels 148 are elongated to allow the guide pins 150 to move within the guide channels 148. Optionally, springs may be provided in the guide channels 148 that are biased against the guide pins 150 to return the spacer 124 to the resting or normal position, which may be at the top of the spacer channel 146.

In an exemplary embodiment, the housing 122 includes fasteners 152 used to secure the housing 122 to the anvil 118. Other securing means may be provided in alternative embodiments. Optionally, the housing 122 may include datum or blocking surfaces that engage the terminal 106 to locate and/or hold the terminal 106 in the terminal cavity 130. For example, such blocking surfaces may block axial movement and/or rotational movement of the terminal 106 within the terminal cavity 130.

The spacer 124 includes a pocket 160 configured to receive a portion of the terminal 106. The spacer 124 extends between a top 162, a bottom 164 and opposite sides 166, 168 extending between the top 162 and the bottom 164. Optionally, the pocket 160 may be open at the top 162 to receive a portion of the terminal 106. The pocket 160 may be open at a front 170 of the spacer 124 to receive the terminal 106. Additionally or alternatively, the pocket 160 may be open at a rear 172 of the spacer 124. In the illustrated embodiment, the pocket 160 may be generally U-shaped to receive a portion of the terminal 106. The pocket 160 may have other shapes in alternative embodiments. The pocket 160 may have different sections for receiving different portions of the terminal 106, such as a forward section and a rearward section.

In an exemplary embodiment, the spacer 124 includes a spacer blocking surface 174 configured to locate the terminal 106 relative to the spacer 124. The spacer blocking surface 174 may directly engage a portion of the terminal 106 to locate the terminal 106 relative to the spacer 124. In an exemplary embodiment, the spacer blocking surface 174 blocks axial rearward movement of the terminal 106. For example, the spacer blocking surface 174 may be positioned rearward of a portion of the terminal 106 to block rearward movement of the terminal 106.

In an exemplary embodiment, the spacer 124 includes a ledge 180 defining a portion of the pocket 160. The ledge 180 defines an anti-rotation surface 182 configured to engage the terminal 106 and block rotation of the terminal 106 about the terminal axis 140. In the illustrated embodiment, the anti-rotation surface 182 is oriented generally vertically; however, the anti-rotation surface 182 may have other orientations in other embodiments. The spacer 124 may include multiple anti-rotation surfaces 182, such as at opposite sides of the pocket 160. The terminal 106 may fit snuggly between the anti-rotation surfaces 182 to prevent rotation of the terminal 106 relative to the spacer 124.

In the illustrated embodiment, the terminal locator 120 includes a pair of the latches 126 on opposite sides of the terminal cavity 130. For example, a first of the latches 126 is provided at the first side 136 and a second of the latches 126 is provided at the second side 138. However, the terminal locator 120 may include any number of latches 126 in alternative embodiments, including a single latch 126. The latches 126 are received in latch openings 190 in the housing 122. Alternatively, the latch openings 190 may be provided in the spacer 124 such that the latches 126 are directly held by the spacer 124, which itself is held by the housing 122. However, in the illustrated embodiment, the latches 126 are moveably coupled to the housing 122.

The latches 126 are deflectable to allow insertion and removal of the terminal 106 from the terminal cavity 130. For example, the latches 126 may be moved between open positions and closed positions. In the closed positions, the latches 126 secure the terminal 106 in the terminal cavity 130. In the open positions, the terminal 106 may be movable relative to the housing 122, such as loaded into the terminal cavity 130 or removed from the terminal cavity 130. In the illustrated embodiment, the latches 126 are moveable axially within the latch openings 190. For example, the latches 126 may slide between the open and closed positions along latch pins 192 in the latch openings 190. The latches 126 may include elongated slots 194 to allow the latches 126 to move laterally within the latch openings 190. Optionally, springs may be provided in the latch openings 190 to bias the latches 126 toward the closed positions. In alternative embodiments, rather than being slidable within the latch openings 190, the latches 126 may be pivotably coupled to the housing 122 to rotate between the opened and closed positions.

The latches 126 include latching ends 196 positionable in the terminal cavity 130 to engage the terminal 106. The latching ends 196 have latch blocking surfaces 198 configured to locate the terminal 106 in the terminal cavity 130. For example, the latch blocking surfaces 198 may engage the terminal 106 and block axial movement of the terminal 106 in the terminal cavity 130. For example, the latches 126 may block axial forward movement of the terminal 106 within the terminal cavity 130. As such, the terminal 106 may be captured between the spacer blocking surface 174 and the latch blocking surfaces 198 to hold the axial position of the terminal 106 within the terminal cavity 130. In the illustrated embodiment, the latch blocking surface 198 is axially offset with respect to the spacer blocking surface 174.

The latching ends 196 may be shaped to interface with the terminal 106. For example, the latching ends 196 may have complementary shapes to the terminal 106. In the illustrated embodiment, each latch 126 includes an angled undercut 200 along a rear edge 202 of the latch 126. The rear edge 202 at the angled undercut 200 defines the latch blocking surface 198 configured to engage the terminal 106. For example, the latch blocking surface 198 may engage an angled forehead of the terminal 106.

The latch 126 may have angled ramps 204 along a top 206 and/or a bottom 208 of the latch 126. The ramps 204 may engage the terminal 106 during insertion or removal of the terminal 106 from the terminal cavity 130. As the terminal 106 is pressed against the ramps 204, the terminal 106 may force the latches 126 to deflect to the open positions automatically. For example, downward pressure on ramps 204 along the tops 206 of the latches 126 may force the latches 126 from closed positions to open positions to allow the terminal 106 to be loaded into the terminal cavity 130. Similarly, upward pressure from the terminal 106 onto ramps 204 at the bottom 208 of the latches 126 may force the latches 126 to move from the closed positions to the open positions to allow removal of the terminal 106 from the terminal cavity 130. The terminal 106 is driven into the ramp 206 during insertion or removal to force the latch 126 to deflect outward to an open position relative to the terminal cavity 130 to allow insertion or removal of the terminal 106.

Figure 5:
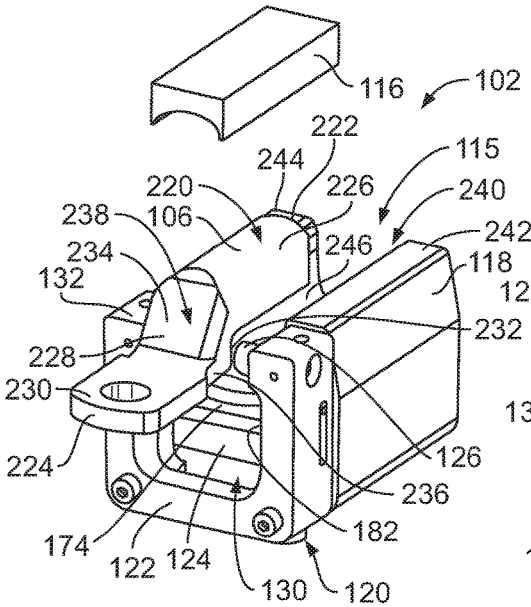
FIG. 5 is a perspective view of a terminal crimping device in accordance with an exemplary embodiment showing a terminal poised for loading into the terminal crimping device.
Figure 6:
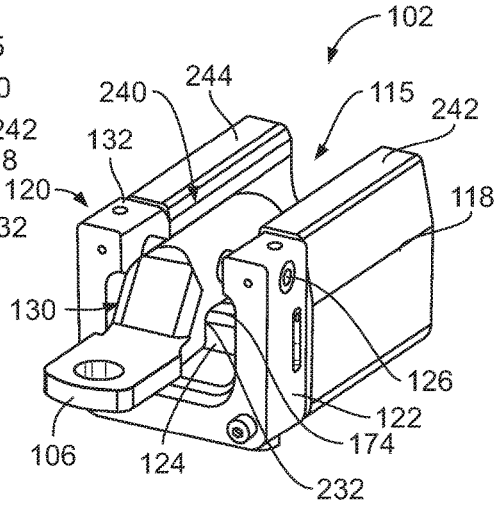
FIG. 6 is a perspective view of the terminal crimping device showing the terminal partially loaded into the terminal crimping device.
Figure 7:
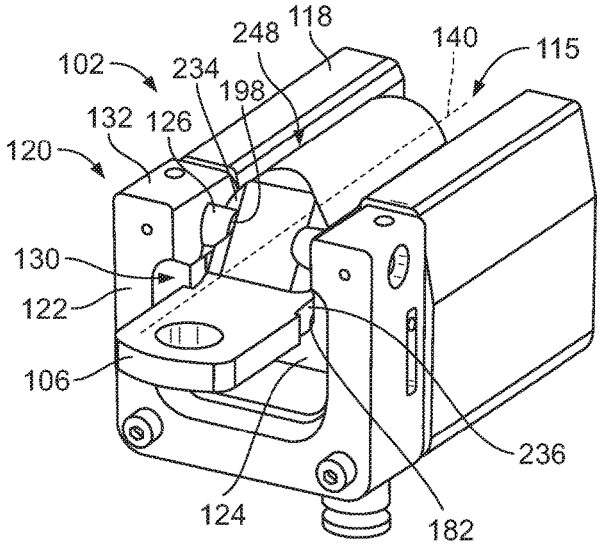
FIG. 7 is a perspective view of the terminal crimping device showing the terminal fully loaded into the terminal crimping device.

FIG. 5 is a perspective view of the terminal crimping device 102 in accordance with an exemplary embodiment showing the terminal 106 poised for loading into the terminal crimping device 102. FIG. 6 is a perspective view of the terminal crimping device 102 showing the terminal 106 partially loaded into the terminal crimping device 102. FIG. 7 is a perspective view of the terminal crimping device 102 showing the terminal 106 fully loaded into the terminal crimping device 102. In the fully loaded position, the terminal locator 120 holds the axial position and/or rotational position of the terminal 106 relative to the anvil 118 of the crimp tooling 114.

The terminal 106 includes a terminating end 220 at a rear 222 of the terminal 106. Optionally, the terminal 106 is closed at a front 224 of the terminal 106. For example, the terminal 106 includes a closed crimp barrel 226 at the terminating end 220 having a closed end 228 that faces the front 224. Optionally, the terminal 106 includes a tab 230 at the front 224, such as a weld tab. The terminal 106 may be another type of terminal having a different type of end at the front 224. Optionally, the terminal 106 is a machined terminal having a closed crimp barrel 226 that is seamless, which is in contrast to a stamped and formed terminal having an open barrel closed during the crimping process. The closed crimp barrel 226 may be more robust and provide a better environmental seal at the interface with the wire 108 (show in FIG. 1) as compared to open barrel crimp terminals.

In an exemplary embodiment, the terminal 106 includes a plurality of bearing surfaces configured to be engaged by the terminal locator 120 to locate and hold the terminal 106 during the crimping process. The bearing surfaces may be used to hold an axial position of the terminal 106 and/or a rotational position of the terminal 106. In the illustrated embodiment, the terminal 106 includes a rear-bearing surface 232, a front-bearing surface 234 and side-bearing surfaces 236. When the terminal 106 is loaded into the terminal crimping device 102, the spacer blocking surface 174 engages the rear-bearing surface 232 to block axial rearward movement of the terminal 106. The latch blocking surface 198 engages the front-bearing surface 234 to block axial forward movement of the terminal 106. The anti-rotation surfaces 182 engage the side-bearing surfaces 236 to block rotation of the terminal 106 about the terminal axis 140.

When the terminal 106 is held in the terminal locator 120, the crimp barrel 226 of the terminal 106 extends rearward of the housing 122 along the terminal axis 140 into the crimping zone 115 for crimping to the wire 108. The crimp barrel 226 is received in the anvil 118 and aligned with the ram 116. During the crimping operation, the ram 116 is moveable along the crimp stroke towards and away from the anvil 118 to crimp the terminal 106 to the wire 108 during the crimp stroke.

In an exemplary embodiment, the anvil 118 includes a channel 240 that receives the crimp barrel 226. In the illustrated embodiment, the channel 240 is U-shaped having side walls 242, 244 and a base 246 between the side walls 242, 244. In an exemplary embodiment, the terminal locator 120 holds the terminal 106 such that the crimp barrel 226 is received in the channel 240 and is spaced apart from the side walls 242, 244 and/or the base 246. For example, gaps 248 are defined between the crimp barrel 226 and the anvil 118. The terminal locator 120 locates the terminal 106 with a high degree of repeatability without the operator needing to physically hold the terminal 106 in place and thus provides hands-free support of the terminal 106 during the crimping operation. During the crimp stroke, the ram 116 may be received in the gaps 248 to engage the crimp barrel 226. The terminal locator 120 holds the side-to-side position of the terminal 106 spaced apart from the anvil 118 such that the ram 116 may be received in the gaps 248 between the crimp barrel 226 and the side walls 242, 244.

During use, the terminal 106 is loaded into the terminal cavity 130 through the open top 132 (FIG. 5). For example, the terminal 106 may be pressed downward into the terminal cavity 130. As the terminal 106 is loaded into the terminal cavity 130, the terminal 106 may press against the latches 126 to deflect the latches to the open position allowing the terminal 106 to pass under the latches 126. The wire 108 may be positioned in the crimp barrel 226 prior to loading the terminal 106 into the terminal crimping device 102.

Optionally, the terminal 106 may be loaded into the terminal crimping device 102 in a slightly forward position (FIG. 6). After the terminal 106 is pressed downward into the terminal cavity 130 the terminal 106 may be moved rearward to position the terminal 106 in the terminal locator 120. As the terminal 106 is moved rearward, the terminal 106 is pushed against the spacer blocking surface 174 of the spacer 124. Once the terminal 106 is pushed rearward far enough (FIG. 7), the latches 126 may return to the closed position thus latching the terminal 106 in the terminal cavity 130. The latch blocking surfaces 198 may engage the front-bearing surface 234 of the terminal 106 at the forehead 238 of the terminal 106. The forehead 238 closes the crimp barrel 226. In the fully loaded position (FIG. 7), the side-bearing surfaces 236 are aligned with and engage the anti-rotation surfaces 182 of the spacer 124. The spacer 124 resists rotation of the terminal 106 within the terminal cavity 130 about the terminal axis 140.

Optionally, during the crimping operation, the terminal 106 may be pressed downward against the anvil 118. The spacer 124 is moveable relative to the housing 122 to accommodate the downward movement of the terminal 106 during the crimping process. After the crimping operation is complete, the terminal 106 and the crimped wire 108 may be removed from the terminal crimping device 102. For example, the terminal 106 may be lifted upward to release the latches 126 and remove the terminal 106 from the terminal cavity 130.

Figure 8:
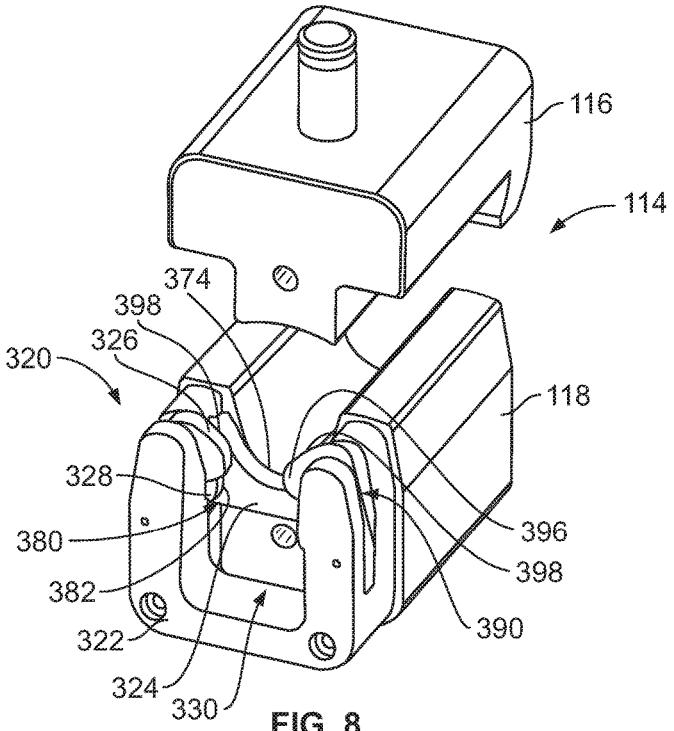
FIG. 8 is a front perspective view of a terminal locator in accordance with an exemplary embodiment.
Figure 9:
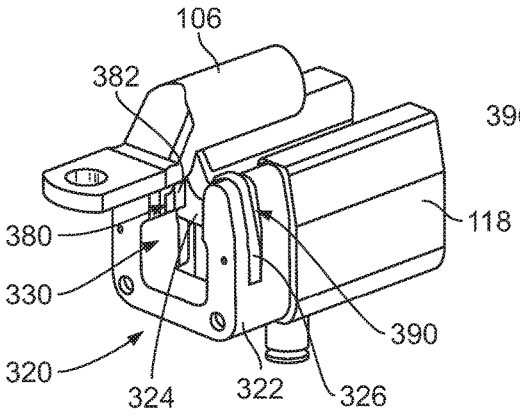
FIG. 9 is a perspective view of the terminal locator showing the terminal poised for loading into the terminal locator.
Figure 10:
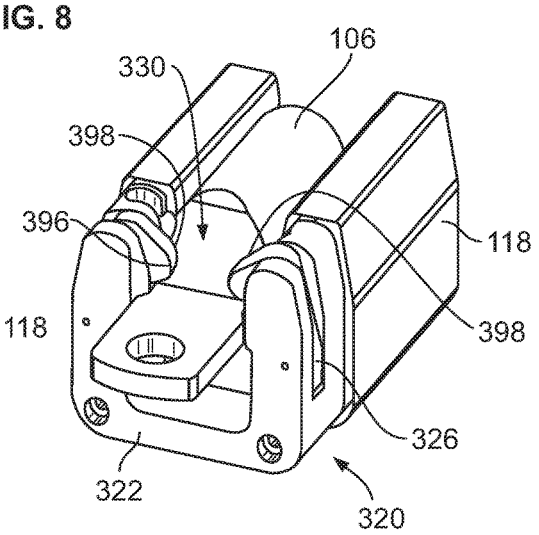
FIG. 10 is front perspective view of the terminal locator showing the terminal loaded into the terminal locator.

FIG. 8 is a front perspective view of a terminal locator 320 in accordance with an exemplary embodiment for use with the crimp tooling 114 in the crimping system 100. FIG. 9 is a perspective view of the terminal locator 320 showing the terminal 106 poised for loading into the terminal locator 320. FIG. 10 is front perspective view of the terminal locator 320 showing the terminal 106 loaded into the terminal locator 320. The terminal locator 320 is similar to the terminal locator 120 (shown in FIG. 1) and like components are identified with like terminology. The terminal locator 320 may replace the terminal locator 120 in the crimping system 100.

The terminal locator 320 includes a housing 322, which may be coupled to the anvil 118, a spacer 324 held by the housing 322, and latches 326 held by the housing 322. The terminal locator 320 is used for holding the terminal 106 in the crimping zone 115. In an exemplary embodiment, the terminal locator 320 is used to block axial movement of the terminal 106 and/or block rotational movement of the terminal 106.

The housing 322 defines a terminal cavity 330 configured to receive the terminal 106 along a terminal axis. In an exemplary embodiment, the housing 322 includes a spacer channel that receives the spacer 324. Optionally, the spacer 324 may be moveable relative to the housing 322 within the spacer channel. In an exemplary embodiment, the housing 322 includes datum or blocking surfaces 328 that engage the terminal 106 to locate and/or hold the terminal 106 in the terminal cavity 330. For example, such blocking surfaces 328 may block axial movement and/or rotational movement of the terminal 106 within the terminal cavity 330. The blocking surface 328 may directly engage a portion of the terminal 106 to locate the terminal 106 relative to the housing 322. In an exemplary embodiment, the blocking surface 328 blocks axial rearward movement of the terminal 106. For example, the blocking surface 328 may be positioned rearward of a portion of the terminal 106 to block rearward movement of the terminal 106. Optionally, the spacer 324 includes a spacer blocking surface 374 configured to locate the terminal 106 relative to the spacer 324.

The blocking surface 328 may block axial movement of the terminal 106 within the terminal cavity 330. For example, the housing 322 may include a ledge 380 defining a portion of the terminal cavity 330. The ledge 380 defines an anti-rotation surface 382 configured to engage the terminal 106 and block rotation of the terminal 106. In the illustrated embodiment, the anti-rotation surface 382 is oriented generally vertically; however, the anti-rotation surface 382 may have other orientations in other embodiments. The housing 322 may include multiple anti-rotation surfaces 382, such as at opposite sides of the terminal cavity 330. The terminal 106 may fit snuggly between the anti-rotation surfaces 382 to prevent rotation of the terminal 106 relative to the housing 322.

In the illustrated embodiment, the terminal locator 320 includes a pair of the latches 326 on opposite sides of the terminal cavity 330. For example, a first of the latches 326 is provided at the first side and a second of the latches 326 is provided at the second side. However, the terminal locator 320 may include any number of latches 326 in alternative embodiments, including a single latch 326. The latches 326 are received in latch openings 390 in the housing 322. The latches 326 are deflectable to allow insertion and removal of the terminal 106 from the terminal cavity 330. For example, the latches 326 may be moved between open positions and closed positions. The latches 326 may be pivotably coupled to the housing 322. Optionally, springs may be provided in the latch openings 390 to bias the latches 326 toward the closed positions.

The latching ends 396 may be shaped to interface with the terminal 106. For example, the latching ends 396 may have complementary shapes to the terminal 106. In the illustrated embodiment, each latch 326 includes an angled undercut along a rear edge of the latch 326. The rear edge at the angled undercut defines the latch blocking surface 398 configured to engage the terminal 106. For example, the latch blocking surface 398 may engage an angled forehead of the terminal 106.

The latches 326 include latching ends 396 positionable in the terminal cavity 330 to engage the terminal 106. The latching ends 396 have latch blocking surfaces 398 configured to locate the terminal 106 in the terminal cavity 330. For example, the latch blocking surfaces 398 may engage the terminal 106 and block axial movement of the terminal 106 in the terminal cavity 330. For example, the latches 326 may block axial forward movement of the terminal 106 within the terminal cavity 330. As such, the terminal 106 may be captured between the blocking surfaces 328 (or blocking surfaces of the spacer 324) and the latch blocking surfaces 398 to hold the axial position of the terminal 106 within the terminal cavity 330.

The latch 326 may have ramps along a top and/or a bottom of the latch 326. The ramps may engage the terminal 106 during insertion or removal of the terminal 106 from the terminal cavity 330. As the terminal 106 is pressed against the ramps, the terminal 106 may force the latches 326 to deflect to the open positions automatically. For example, downward pressure on ramps along the tops of the latches 326 may force the latches 326 from closed positions to open positions to allow the terminal to be loaded into the terminal cavity 330. Similarly, upward pressure from the terminal 106 onto ramps at the bottom of the latches 326 may force the latches 326 to move from the closed positions to the open positions to allow removal of the terminal 106 from the terminal cavity 330.

Figure 11:
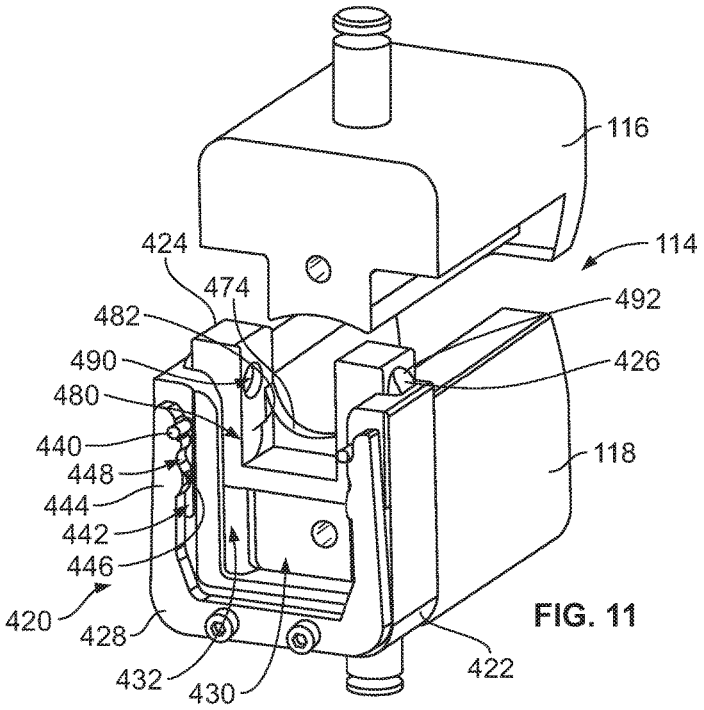
FIG. 11 is a front perspective view of a terminal locator in accordance with an exemplary embodiment.
Figure 12:
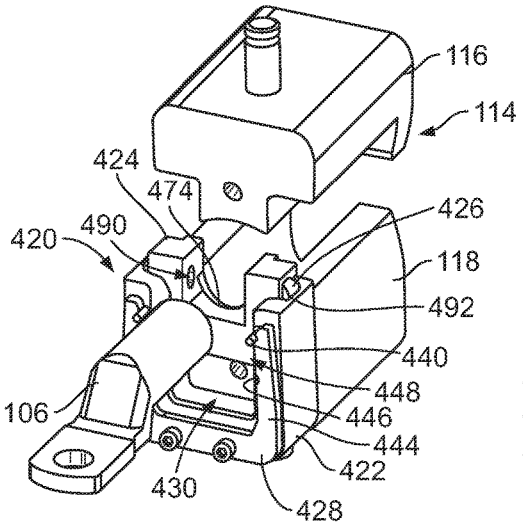
FIG. 12 is a front perspective view of the terminal locator showing the terminal poised for loading into the terminal locator.
Figure 13:
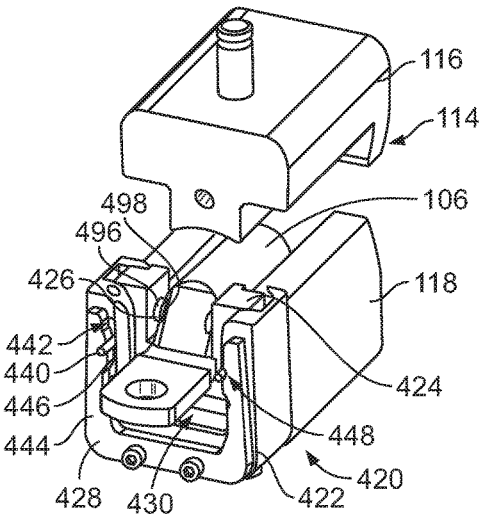
FIG. 13 is front perspective view of the terminal locator showing the terminal loaded into the terminal locator.
Figure 14:
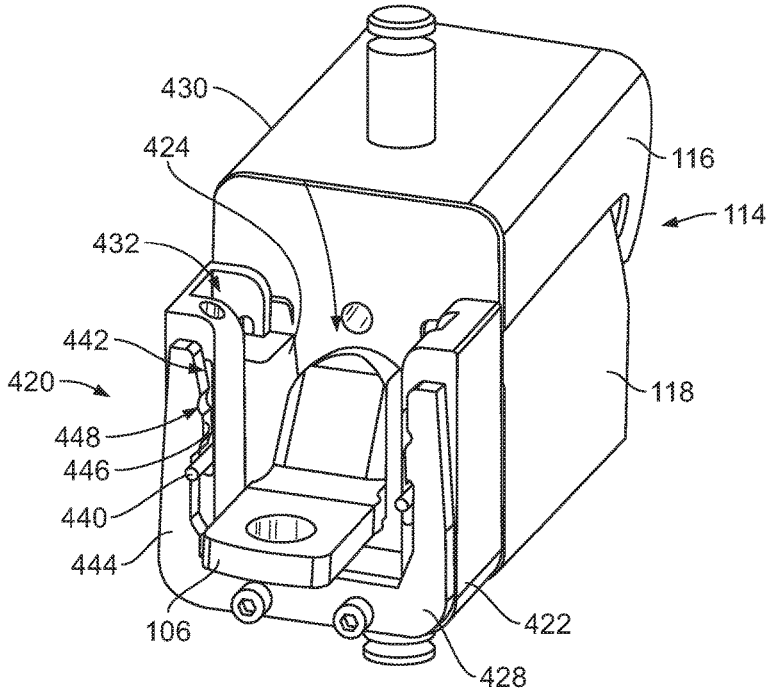
FIG. 14 is front perspective view of the terminal locator showing the terminal at the bottom of the crimp stroke.

FIG. 11 is a front perspective view of a terminal locator 420 in accordance with an exemplary embodiment for use with the crimp tooling 114 in the crimping system 100. FIG. 12 is a front perspective view of the terminal locator 420 showing the terminal 106 poised for loading into the terminal locator 420. FIG. 13 is front perspective view of the terminal locator 420 showing the terminal 106 loaded into the terminal locator 420. FIG. 14 is front perspective view of the terminal locator 420 showing the terminal 106 at the bottom of the crimp stroke. The terminal locator 420 is similar to the terminal locator 120 (shown in FIG. 1) and like components are identified with like terminology. The terminal locator 420 may replace the terminal locator 120 in the crimping system 100.

The terminal locator 420 includes a housing 422, which may be coupled to the anvil 118, a spacer 424 held by the housing 422, latches 426 held by the housing 422 and a spring plate 428 held by the housing 422. The spacer 424 is similar to the spacer 124 (shown in FIG. 2); however the spacer 424 includes latch openings 490 similar to the latch openings 190 that are located in the housing 122 (both shown in FIG. 2). As such, the latches 426 are held by the spacer 424, which is in turn held by the housing 422. The spring plate 428 is used to hold the spacer 424 relative to the housing 422 at a plurality of predetermined positions, such as for loading the terminal 106 in the terminal locator 420, for holding the terminal 106 in the terminal locator 420 during the crimping process and for allowing the terminal 106 to be released from the terminal locator 420. In an exemplary embodiment, the terminal locator 420 is used to block axial movement of the terminal 106 and/or block rotational movement of the terminal 106 during the crimping process.

The housing 422 defines a terminal cavity 430 configured to receive the terminal 106 along a terminal axis. In an exemplary embodiment, the housing 422 includes a spacer channel 432 that receives the spacer 424. Optionally, the spacer 424 may be moveable relative to the housing 422 within the spacer channel 432. Optionally, the housing 422 may include datum or blocking surfaces that engage the terminal 106 to locate and/or hold the terminal 106 in the terminal cavity 430, such as to block axial movement and/or rotational movement of the terminal 106 within the terminal cavity 430.

In an exemplary embodiment, the spacer 424 includes spacer blocking surfaces 474, which may be similar to the spacer blocking surfaces 174 (shown in FIG. 2), to locate the terminal 106 relative to the spacer 424. The spacer blocking surfaces 474 block axial movement of the terminal 106 within the terminal cavity 430. The spacer 424 includes ledges 480 that define anti-rotation surfaces 482, which may be similar to the anti-rotation surfaces 182 (shown in FIG. 2), configured to engage the terminal 106 and block rotation of the terminal 106.

In the illustrated embodiment, the terminal locator 420 includes a pair of the latches 426 on opposite sides of the terminal cavity 430. For example, a first of the latches 426 is provided at the first side and a second of the latches 426 is provided at the second side. However, the terminal locator 420 may include any number of latches 426 in alternative embodiments, including a single latch 426. The latches 426 are received in the latch openings 490 in the spacer 424. The latches 426 are deflectable to allow insertion and removal of the terminal 106 from the terminal cavity 430. For example, the latches 426 may be moved between open positions and closed positions. The latches 426 may be pivotably coupled to the spacer 424 in various embodiments. Optionally, springs may be provided in the latch openings 490 to bias the latches 426 toward the closed positions in various embodiments. However, in an exemplary embodiment, the latches 426 are spring biased to the open positions and are forced to the closed positions by the housing 422. When the spacer 424 is moved downward into the housing 422, a portion of the housing 422 engages the latches 426 and pushes the latches 426 to the closed positions. For example, the spacer channel 432 may be profiled and include protrusions that engage the latches 426 to move the latches 426 inward as the spacer 424 is moved downward into the spacer channel 432.

The latches 426 include outer ends 492, which may be positioned outside of the spacer 424 in the open positions (FIG. 12). The outer ends 492 are configured to engage the housing 422 when the spacer 424 is moved to the loaded position in the housing 422. The housing 422 may force the outer ends 492 and the latches 426 inward to the closed positions (FIG. 13). The latches 426 include latching ends 496 positionable in the terminal cavity 430 to engage the terminal 106 in the closed positions. The latching ends 496 have latch blocking surfaces 498 configured to locate the terminal 106 in the terminal cavity 430. For example, the latch blocking surfaces 498 may engage the terminal 106 and block axial movement of the terminal 106 in the terminal cavity 430. For example, the latches 426 may block axial forward movement of the terminal 106 within the terminal cavity 430. As such, the terminal 106 may be captured between the spacer blocking surfaces 474 and the latch blocking surfaces 498 to hold the axial position of the terminal 106 within the terminal cavity 430.

The latching ends 496 may be shaped to interface with the terminal 106. For example, the latching ends 496 may have complementary shapes to the terminal 106. In the illustrated embodiment, each latch 426 includes an angled undercut along a rear edge of the latch 426. The rear edge at the angled undercut defines the latch blocking surface 498 configured to engage the terminal 106. For example, the latch blocking surface 498 may engage an angled forehead of the terminal 106.

The latch 426 may have ramps along a top and/or a bottom of the latch 426. The ramps may engage the terminal 106 during insertion or removal of the terminal 106 from the terminal cavity 430. As the terminal 106 is pressed against the ramps, the terminal 106 may force the latches 426 to deflect to the open positions automatically. For example, downward pressure on ramps along the tops of the latches 426 may force the latches 426 from closed positions to open positions to allow the terminal to be loaded into the terminal cavity 430. Similarly, upward pressure from the terminal 106 onto ramps at the bottom of the latches 426 may force the latches 426 to move from the closed positions to the open positions to allow removal of the terminal 106 from the terminal cavity 430.

In an exemplary embodiment, the spacer 424 has locating pins 440 extending forward therefrom. The locating pins 440 pass through slots 442 in the housing 422 and interact with the spring plate 428 to position the spacer 424 relative to the housing 422. The spring plate 428 includes arms 444 each having a profiled surface defining a ratchet 446 that interacts with the locating pins 440. The ratchet 446 is defined by notches 448 in the arm 444. The locating pin 440 may be retained in the notches 448 to hold the relative position of the spacer 424. The arm 444 is deflectable to allow the locating pin 440 to move between the notches 448 when sufficient pressure is applied to the spacer 424 to move the spacer 424 (e.g., downward or upward) to the next notch 448.

In an exemplary embodiment, the spacer 424 is movable between an unlocked position (FIG. 12) and a locked position (FIG. 13). In the unlocked position, the latches 426 are configured to be positioned in the open positions allowing the terminal 106 to be loaded into the terminal cavity 430 and/or removed from the terminal cavity 430. In the illustrated embodiment, the unlocked position corresponds to an upper or top-most position. The spacer 424 may be moved downward to the locked position, such as by pushing the spacer 424 downward with the terminal 106 is loaded into the terminal cavity 430. In the locked position, the latches 426 are closed (e.g., pushed inward) to hold the terminal 106 in the terminal cavity 430. The latches 426 may be moved to the closed positions by the housing 422. For example, as the spacer 424 is moved downward, the outer ends 492 of the latches 426 engage the housing 422 and the housing 422 forces the latches 426 inward. The spacer 424 may be movable to other positions, such as a release position (FIG. 14) where the terminal 106 may be released from the terminal cavity 430. Optionally, the release position may be below the locked position. For example, during the crimping process, the ram 116 may press the terminal 106 and the spacer 424 downward relative to the housing to the release position. In the release position, the latches 426 may be allowed to move outward to the open position to allow the terminal 106 to be removed from the terminal cavity 430.

Figure 15:
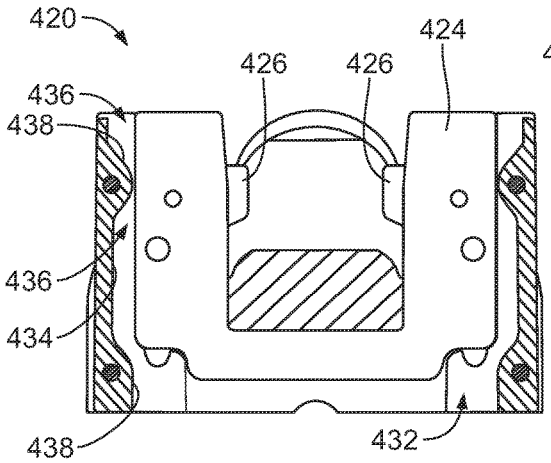
FIG. 15 is a cross-sectional view of the terminal locator showing the spacer in the locked position.
Figure 16:
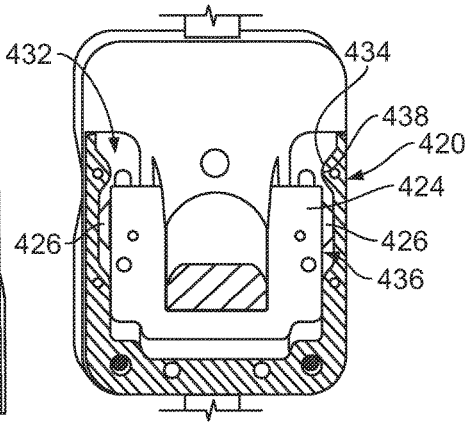
FIG. 16 is a cross-sectional view of the terminal locator showing the spacer in the release position.

FIG. 15 is a cross-sectional view of the terminal locator 420 showing the spacer 424 in the locked position. FIG. 16 is a cross-sectional view of the terminal locator 420 showing the spacer 424 in the release position. The spacer channel 432 is shown in FIGS. 15 and 16 showing a profiled edge 434 including pockets 436 and protrusions 438 along the profiled edge 434. When the latches 426 are aligned with the protrusions 438, the protrusions 438 force the latches 426 inward to the closed positions (FIG. 15). When the latches 426 are aligned with the pockets 436, the latches 426 are allowed to be spring biased outward to the open positions (FIG. 16) to allow the terminal 106 to be removed from the spacer 424.

Figure 17:
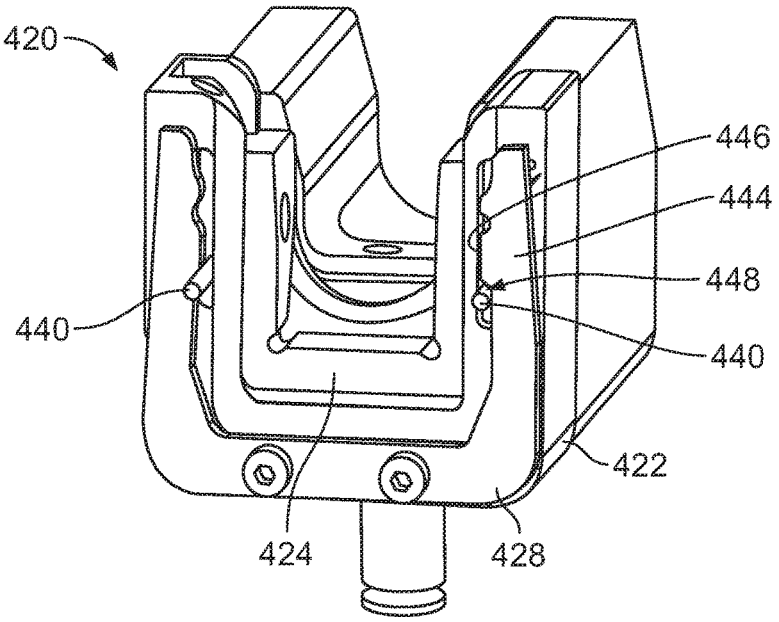
FIG. 17 is a front perspective view of the terminal locator.

FIG. 17 is a front perspective view of the terminal locator 420 without the terminal 106 to illustrate the various features of the spacer 424, the housing 422 and the spring plate 428. FIG. 17 shows the spacer 424 in the release position. The locating pins 440 are held in notches 448 in the ratchets 446 along the arms 444 of the spring plate 428. The spacer 424 may be moved upward from the release position, such as back to the unlocked position, by lifting up on the spacer 424. Optionally, a handle may be coupled to the spacer 424 that allows the operator to manually lift the spacer 424 upward to reset the terminal locator 420 for receiving the next terminal 106. In other various embodiments, the spacer 424 may be reset automatically, such as by the crimping machine 104 as part of the return stroke of the crimping machine.

Figure 18:
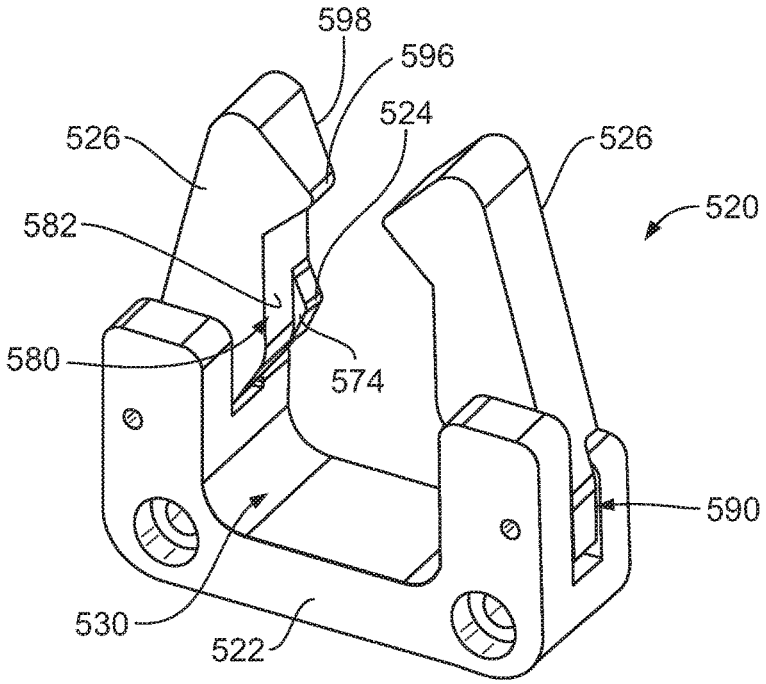
FIG. 18 is a front perspective view of a terminal locator in accordance with an exemplary embodiment.

FIG. 18 is a front perspective view of a terminal locator 520 in accordance with an exemplary embodiment for use with the crimp tooling 114 in the crimping system 100. The terminal locator 520 is similar to the terminal locator 120 (shown in FIG. 1) and like components are identified with like terminology. The terminal locator 520 may replace the terminal locator 120 in the crimping system 100.

The terminal locator 520 includes a housing 522, which may be coupled to the anvil 118, a spacer 524 held by the housing 522, and latches 526 held by the housing 522. In the illustrated embodiment, the spacer 524 is an integral part of the latches 526. For example, each latch 526 may include a spacer 524 in the form of a protrusion extending therefrom configured to engage the terminal 106. The terminal locator 520 is used for holding the terminal 106 in the crimping zone 115. In an exemplary embodiment, the terminal locator 520 is used to block axial movement of the terminal 106 and/or block rotational movement of the terminal 106.

The housing 522 defines a terminal cavity 530 configured to receive the terminal 106 along a terminal axis. Optionally, the housing 522 may include datum or blocking surfaces that engage the terminal 106 to locate and/or hold the terminal 106 in the terminal cavity 530. For example, such blocking surfaces may block axial movement and/or rotational movement of the terminal 106 within the terminal cavity 530.

The spacers 524 include spacer blocking surfaces 574 configured to locate the terminal 106 relative to the spacer 524. The spacer blocking surfaces 574, which may be similar to the spacer blocking surfaces 174 (shown in FIG. 2), locate the terminal 106 within the terminal locator 520. The spacer blocking surfaces 474 block axial rearward movement of the terminal 106 within the terminal cavity 430.

In an exemplary embodiment, the latches 526 include ledges 580. The ledges 580 define anti-rotation surfaces 582 configured to engage the terminal 106 and block rotation of the terminal 106. In the illustrated embodiment, the anti-rotation surfaces 582 are oriented generally vertically; however, the anti-rotation surfaces 582 may have other orientations in other embodiments. The terminal 106 may fit snuggly between the anti-rotation surfaces 582 to prevent rotation of the terminal 106 relative to the housing 522. In various embodiments, the housing 522 and/or the spacers 524 may include anti-rotation surfaces.

In the illustrated embodiment, the terminal locator 520 includes a pair of the latches 526 on opposite sides of the terminal cavity 530. For example, a first of the latches 526 is provided at the first side and a second of the latches 526 is provided at the second side. However, the terminal locator 520 may include any number of latches 526 in alternative embodiments, including a single latch 526. The latches 526 are received in latch openings 590 in the housing 522. The latches 526 are deflectable to allow insertion and removal of the terminal 106 from the terminal cavity 530. For example, the latches 526 may be moved between open positions and closed positions. In the illustrated embodiment, the latches 526 are pivotably coupled to the housing 522. Optionally, springs may be provided in the latch openings 590 to bias the latches 526 toward the closed positions.

The latching ends 596 may be shaped to interface with the terminal 106. For example, the latching ends 596 may have complementary shapes to the terminal 106. In the illustrated embodiment, each latch 526 includes an angled undercut along a rear edge of the latch 526. The rear edge at the angled undercut defines a latch blocking surface 598 configured to engage the terminal 106. For example, the latch blocking surface 598 may engage an angled forehead of the terminal 106. The latch blocking surfaces 598 may engage the terminal 106 and block axial movement of the terminal 106 in the terminal cavity 530. For example, the latches 526 may block axial forward movement of the terminal 106 within the terminal cavity 530.

The latch 526 may have ramps along a top and/or a bottom of the latch 526. The ramps may engage the terminal 106 during insertion or removal of the terminal 106 from the terminal cavity 530. As the terminal 106 is pressed against the ramps, the terminal 106 may force the latches 526 to deflect to the open positions automatically. For example, downward pressure on ramps along the tops of the latches 526 may force the latches 526 from closed positions to open positions to allow the terminal to be loaded into the terminal cavity 530. Similarly, upward pressure from the terminal 106 onto ramps at the bottom of the latches 526 may force the latches 526 to move from the closed positions to the open positions to allow removal of the terminal 106 from the terminal cavity 530.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A terminal locator for holding a terminal in a crimping zone of a terminal crimping device, the terminal locator comprising:

a housing configured to be positioned forward of crimp tooling defining the crimping zone, the housing having a terminal cavity extending along a terminal axis and configured to receive the terminal such that a crimp barrel of the terminal extends rearward of the housing along the terminal axis into the crimping zone for crimping to a wire;

a spacer held by the housing, the spacer having a spacer blocking surface configured to locate the terminal and block axial rearward movement of the terminal; and a latch held by the housing, the latch being deflectable to allow insertion and removal of the terminal from the terminal cavity, the latch having a latch blocking surface configured to locate the terminal and block axial forward movement of the terminal.

2. The terminal locator of claim 1, wherein at least one of the housing, spacer and latch include an anti-rotation surface configured to engage the terminal in the terminal cavity and block rotation of the terminal about the terminal axis.

3. The terminal locator of claim 1, wherein the spacer is movable relative to the housing.

4. The terminal locator of claim 1, wherein the housing includes guide channels, the spacer includes guide pins received in the guide channels, the spacer being movable relative to the housing with the guide pins guiding movement of the spacer as the guide pins move in the guide channels.

5. The terminal locator of claim 1, wherein the latch is received in a latch opening, the latch being movable relative to the housing in the latch opening.

6. The terminal locator of claim 1, wherein the latch is movably coupled to the spacer.

7. The terminal locator of claim 1, wherein the latch blocking surface is axially offset with respect to the spacer blocking surface.

8. The terminal locator of claim 1, wherein the latch includes an angled undercut along a rear edge of the latch, the rear edge at the angled undercut defining the latch blocking surface configured to engage an angled forehead of the terminal.

9. The terminal locator of claim 1, wherein the latch includes an angled ramp, the terminal being driven into the ramp during insertion or removal to force the latch to deflect outward relative to the terminal cavity to allow insertion or removal of the terminal.

10. The terminal locator of claim 1, wherein the housing includes a ledge in the terminal cavity defining an anti-rotation surface configured to engage the terminal and block rotation of the terminal about the terminal axis.

11. The terminal locator of claim 1, wherein the spacer includes a U-shaped channel configured to receive the terminal and engage the terminal to stop axial and rotational movement of the terminal.

12. The terminal locator of claim 1, wherein the latch defines a first latch, the terminal locator further comprising a second latch held by the housing on an opposite side of the terminal cavity from the first latch.

13. The terminal locator of claim 1, wherein the housing includes a spacer channel receiving the spacer, the spacer being movable perpendicular to the terminal axis in the spacer channel.

14. The terminal locator of claim 13, wherein the housing includes a spring plate having a ratchet configured to hold the spacer at a plurality of predefined positions relative to the housing.

15. The terminal locator of claim 13, wherein the spacer is movable between an unlocked position and a locked position, the latch being open in the unlocked position and the latch being closed in the locked position, the terminal cavity configured to receive the terminal in the unlocked position, the latch configured to retain the terminal in the terminal cavity in the locked position.

16. The terminal locator of claim 15, wherein the latch is movably coupled to the spacer, the housing including a profiled ledge in the spacer channel configured to engage the latch and force the latch to the closed position when the spacer and the latch are moved in the spacer channel from the unlocked position to the locked position.

17. A terminal crimping device that crimps a terminal to a wire, the terminal crimping device comprising:

crimp tooling including a movable ram and an anvil defining a crimping zone, the movable ram being movable along a crimp stroke towards and away from the anvil, the crimp tooling crimping the terminal to the wire during the crimp stroke; and a terminal locator configured to hold the terminal in the crimping zone during the crimp stroke, the terminal locator comprising:

a housing positioned forward of the crimp tooling defining the crimping zone, the housing having a terminal cavity extending along a terminal axis and configured to receive the terminal such that a crimp barrel of the terminal extends rearward of the housing along the terminal axis into the crimping zone;

a spacer held by the housing, the spacer having a spacer blocking surface configured to locate the terminal and block axial rearward movement of the terminal; and a latch held by the housing, the latch being deflectable to allow insertion and removal of the terminal from the terminal cavity, the latch having a latch blocking surface configured to locate the terminal and block axial forward movement of the terminal.

18. The terminal crimping device of claim 17, wherein the terminal locator is coupled to a front end of the anvil.

19. The terminal crimping device of claim 17, wherein the spacer is movable relative to the housing.

20. A crimping system comprising:

a driving mechanism driven in an axial driving direction during a crimping operation;

crimp tooling including a movable ram and an anvil defining a crimping zone, the movable ram being coupled to the driving mechanism and movable along a crimp stroke towards and away from the anvil by the driving mechanism during the crimping operation, the crimp tooling crimping the terminal to the wire during the crimp stroke; and a terminal locator configured to hold the terminal in the crimping zone during the crimp stroke, the terminal locator comprising:

a housing positioned forward of the crimp tooling, the housing having a terminal cavity extending along a terminal axis and configured to receive the terminal such that a crimp barrel of the terminal extends rearward of the housing along the terminal axis into the crimping zone;

a spacer held by the housing, the spacer having a spacer blocking surface configured to locate the terminal and block axial rearward movement of the terminal; and a latch held by the housing, the latch being deflectable to allow insertion and removal of the terminal from the terminal cavity, the latch having a latch blocking surface configured to locate the terminal and block axial forward movement of the terminal.

* * * * *